US007253714B1

(12) United States Patent
Tsui

(10) Patent No.: US 7,253,714 B1
(45) Date of Patent: Aug. 7, 2007

(54) POWER SUPPLY TRANSFORMER WITH HIGH EFFICIENCY

(75) Inventor: Yuan-Wen Tsui, Shu Lin (TW)

(73) Assignee: General Components Industry Corp., Shu Lin, Taipei Hsien (TW)

( * ) Notice: Subject to any disclaimer, the term of this patent is extended or adjusted under 35 U.S.C. 154(b) by 0 days.

(21) Appl. No.: 11/469,583

(22) Filed: Sep. 1, 2006

(51) Int. Cl.
*H01F 27/28* (2006.01)

(52) U.S. Cl. ..... 336/229

(58) Field of Classification Search ..... 336/65, 336/206–209, 225, 229, 234
See application file for complete search history.

(56) References Cited

U.S. PATENT DOCUMENTS 3,710,531 A * 1/1973 Bielawski ..... 53/409
4,459,576 A * 7/1984 Fox et al. ..... 336/84 C
5,353,494 A * 10/1994 Bisbee et al. ..... 29/605
5,838,220 A * 11/1998 Hagberg ..... 336/206
7,142,085 B2 * 11/2006 Phadke ..... 336/229

* cited by examiner

*Primary Examiner*—Tuyen T. Nguyen
(74) *Attorney, Agent, or Firm*—Ming Chow; Sinorica, LLC

(57) ABSTRACT

A high-efficiency power supply transformer improved on its iron core which is a closed annular member made by continuous winding a silicon steel sheet and completed by sintering and fixing to keep directionality, after insulation processing with a heat shrinking wrapper on the core, a primary coil is formed by winding a wire annularly, then is enveloped by second time insulation processing with a heat shrinking wrapper; then a secondary coil is formed by winding a wire annularly and is enveloped by third time insulation processing with a heat shrinking wrapper; and pairs of end input wires of the primary and of the secondary coils extend outwards. With the core in the form of a closed annular member, its magnetic circuit is a closed magnetic circuit; hence its magnetizing energy and core consumption are 25% less than those of a conventional stacking type core and largely increase the efficiency of the power supply.

9 Claims, 6 Drawing Sheets

| | Input | Loaded | No load | Efficiency | LOAD REGULATION |
|---|---|---|---|---|---|
| 220V 9W | 220V 50Hz | 9.0VAC+5% @1000mA | 11.0VAC + 5% | ≧ 70% | < 15% |
| 230V 12W | 230V 50Hz | 12.0VAC+5% @1000mA | 14.9VAC+ 5% | ≧ 70% | < 15% |
| 120V 9W | 120V 60Hz | 9.0VAC+5% @1000mA | 11.0VAC + 5% | ≧ 70% | < 15% |
| 120V 12W | 120V 60Hz | 12.0VAC+5% @1000mA | 14.9VAC+ 5% | ≧ 70% | < 15% |

FIG.4

POWER SUPPLY TRANSFORMER WITH HIGH EFFICIENCY

BACKGROUND OF THE INVENTION

1. Field of the Invention

The present invention relates to a power supply transformer with high efficiency, and especially to a power supply transformer of which the iron core is a closed annular member made by continuous winding of a silicon steel sheet. By using a manufacturing technique for the present invention, the present invention can be more applicable for a miniaturized transformer with a low power of less than 50 W made from annular linear member.

2. Description of the Prior Art

In the present designing for a conventional linear power supply transformer, an iron core is formed by punching a big silicon steel sheet into sheets with shapes of "E" or "I"; then these sheets are stacked for assembling. In punching for such an iron core of the conventional transformer, directionality of the silicon steel sheets will be damaged; and in completion of the punching, the gaps between every two neighboring "E" sheets or "I" sheets will create larger energy of magnetizing and consumption of the iron core, and the efficiency of the power supply will be lowered.

And more, by the fact that the magnetic conductivity of a conventional power supply transformer can only reach 1.2~1.4 T (tesla), a primary and a secondary copper wire coil of high specifications made by winding must be adopted, this results larger weight and volume of the entire power supply transformer, thus inconvenience of use is resulted.

For the known annular transformers, they can only suit large scale transformers because of the problem of manufacturing procedure for them. Such large scale transformers have mylar plastic tapes for enveloping and separating for insulation, then their coils are wound. During enveloping by the mylar plastic tapes and coil winding conventionally, quite large manpower is required; this is time consumptive and has low efficiency, and is not economic to be used to produce miniaturized power supply transformers, thus improvement is necessary.

SUMMARY OF THE INVENTION

In view of the above defects resided in the conventional transformers made from stacking type iron cores, the present invention provides a power supply transformer with high efficiency, it is improved mainly on its iron core portion which is a closed annular member made by continuous winding from a silicon steel sheet, the iron core then is completed by being sintered and fixed to keep its directionality. After first time insulation processing with a heat shrinking wrapper on the iron core, a primary coil is formed by winding a wire in annular shapes; then the primary coil is enveloped by second time insulation processing with a heat shrinking wrapper. After that, a secondary coil is formed by winding a wire in annular shapes, and the secondary coil is enveloped by third time insulation processing with a heat shrinking wrapper; and a pair of end input wires of the primary coil as well as a pair of end output wires of the secondary coil are extended outwards to thereby form an annular transformer.

The annular transformer of the present invention is mounted in a housing; the input wires of the transformer are connected to a plug outside of the housing for obtaining electric power, while the output wires are electronically connected to an electric power line of an electronic product. The housing can be designed to be a mouse for a computer.

The power supply transformer with high efficiency of the present invention has its iron core in the form of a closed annular member, its magnetic circuit basically is a closed magnetic circuit, thereby its energy of magnetizing and consumption of the iron core are 25% less than those of a conventional stacking type iron core, this largely increases the efficiency of the power supply. Moreover, the iron core is a closed annular member having no air gap, its stacking factor is high up to 95%, the magnetic conductivity of the iron core can reach 1.5~1.8 T (tesla), a primary and a secondary copper wire coil of low specifications made by winding are adopted, this results large reducing of weight and volume of the entire power supply transformer.

The power supply transformer with high efficiency of the present invention can be an A.C. to A.C. transformer with a frequency of 50 or 60 MHz; and can be an A.C. to D.C. transformer, it needs only to add a rectifying filtering circuit on the output end of the secondary coil to change the output voltage from A.C. to D.C.

The power supply transformer with high efficiency of the present invention can have its input voltage and its output voltage changed at will in pursuance of requirement; its power can also be changed by magnitude in pursuance of the size of the annular iron core and the copper wires in designing.

The coils in the power supply transformer with high efficiency of the present invention are directly wound around the iron core having been insulation processed, and need no fixing with a bobbin (a coil of a normal power supply transformer must be wound around a bobbin before it is mounted on an iron core).

The power supply transformer with high efficiency of the present invention is heated after its iron core is wrapped with a PVC heat shrinking wrapper and is fixed with a tool, the PVC material is completely combined with the iron core to render the surface of the iron core insulated.

After the primary coil of the power supply transformer with high efficiency of the present invention is formed by being uniformly wound by using an annular winding machine, it is wrapped and insulated with a PVC heat shrinking wrapper, the secondary coil is wound around the insulating coat formed by the heat shrinking wrapper, this is different from the conventional mode of insulation with mylar plastic tapes.

The magnetizing current of the power supply transformer with high efficiency of the present invention is zero when in no load of a linear power source with a rated input voltage; while the magnetizing current when in no load of a normal linear power source with rated input voltage is larger than zero. And more, the linear power source provided in the present invention can still work normally after being burned in full load with 125% input voltage for 24 hours; while the normal linear power source is unable to work normally after being burned in full load with 125% input voltage for 24 hours.

The efficiency of the power supply transformer with high efficiency of the present invention with a rated input voltage and a rated output power is larger than 70% (the efficiency of a conventional linear power source is lower than 60%).

The surface temperature of the power supply transformer with high efficiency of the present invention after being burned in full load with 125% input voltage for 24 hours rises no more than 40° C. (the temperature rises more than 75° C. for a normal linear power source).

The power supply transformer of the present invention can be used as a transformer for direct inserting into an electric circuit board, and can also be used as a rectifier for a fluorescent lamp.

By the fact that the iron core of the power supply transformer of the present invention can be made by winding short silicon steel sheets, not like the conventional way requiring punching cutting, it has no waste material created in production; and the sheets can be reused as regenerating material, thus have the effect of environment conservation.

The present invention will be apparent after reading the detailed description of the preferred embodiment thereof in reference to the accompanying drawings.

BRIEF DESCRIPTION OF THE DRAWINGS

FIG. 4 is a chart showing the specification of electric features of the present invention;

DETAILED DESCRIPTION OF THE PREFERRED EMBODIMENT

Figure 1:
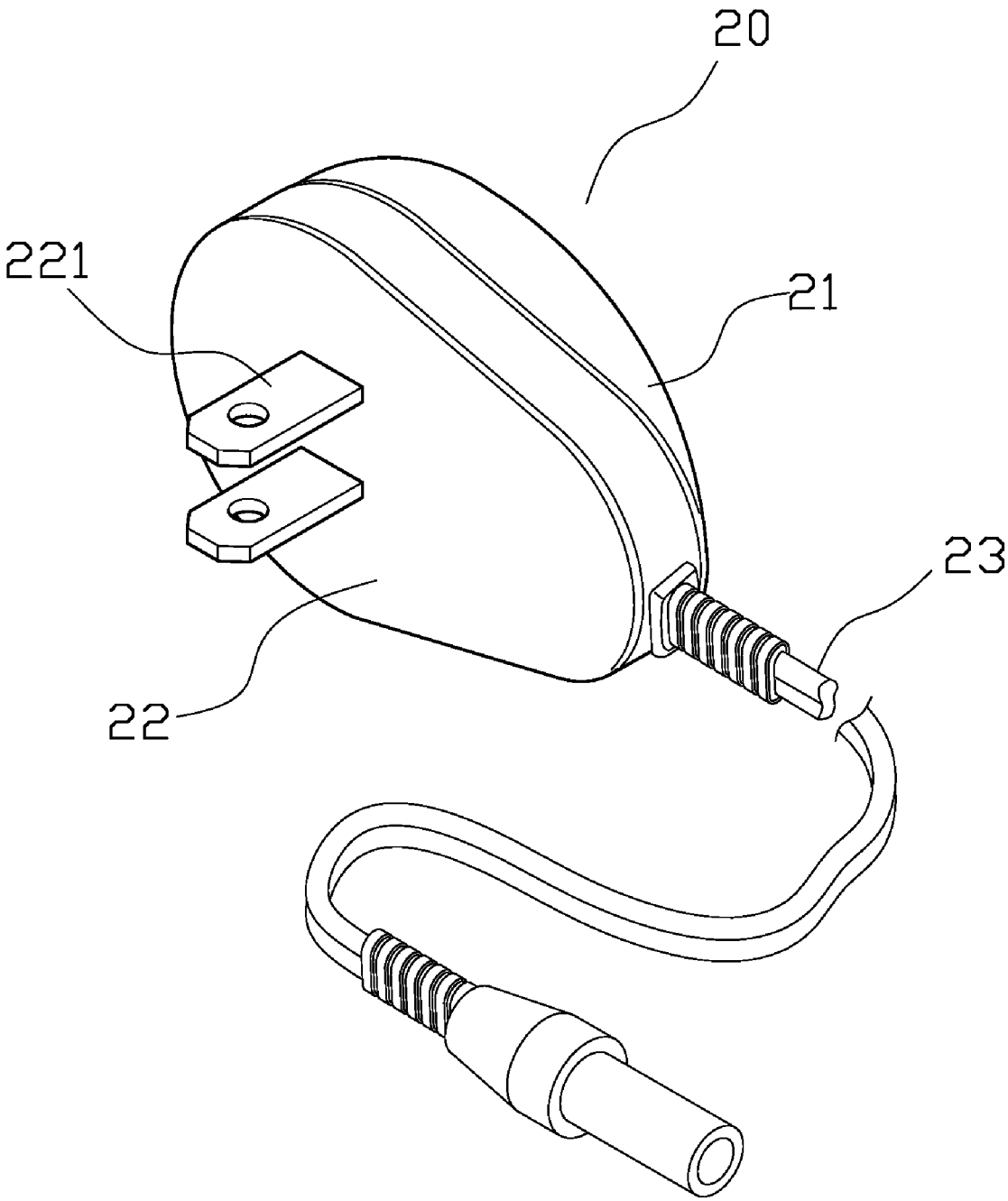
FIG. 1 is a perspective view showing the appearance of a preferred embodiment of the present invention.
Figure 2:
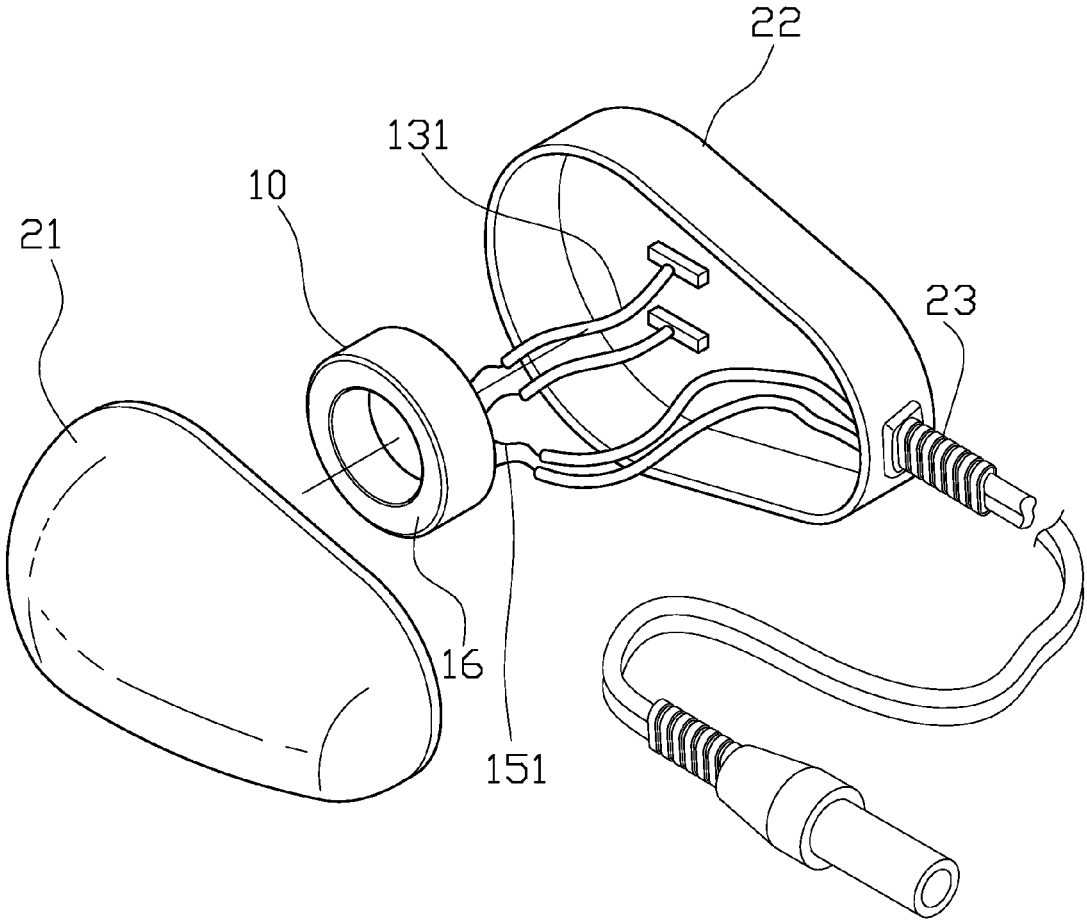
FIG. 2 is an anatomic perspective view of the present invention.

Referring to FIGS. 1 and 2, the power supply transformer with high efficiency of the present invention has an annular transformer 10 mounted in a housing 20 composed of an upper cover 21 and a lower cover 22. A plug 221 is provided on the bottom of the lower cover 22; a power source line 23 is extended out of the housing 20 to connect with an electronic device.

Figure 3A:
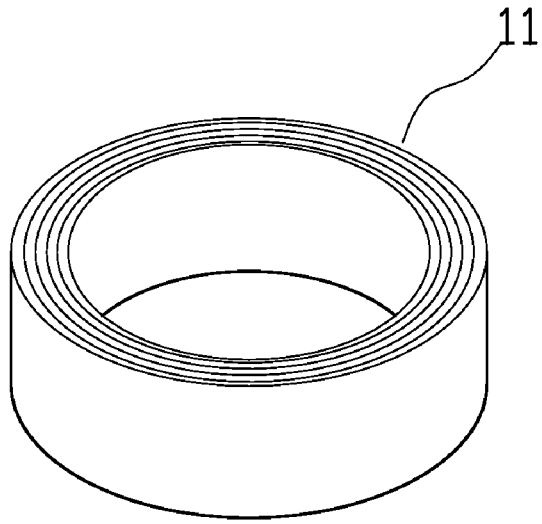
FIGS. 3A to 3E are perspective schematic views showing the process of manufacturing of the present invention.

Referring to FIGS. 3A to 3E showing the process of manufacturing of the annular transformer 10, FIG. 3A discloses an iron core 11 of the present invent, in forming, a silicon steel roll is parallely cut, the cut silicon steel sheet is continuously wound by using an automatic winding machine to form a closed annular member; the closed annular member is sintered in nitrogen gas, annealed in a tunnel, and is immersed in vacuum immersing paint and is baked to have its shape fixed, this can substantially keep the directionality of material.

Figure 3B:
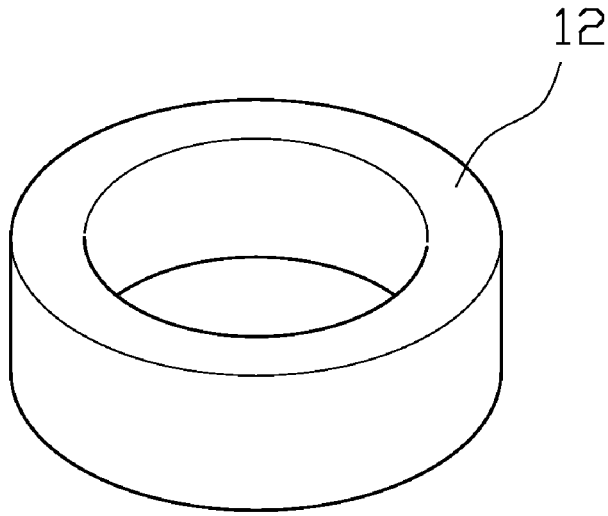

In FIG. 3B, it is disclosed that the iron core 11 is first time processed by insulation processing, a PVC heat shrinking wrapper is used to form a first insulation layer 12 in the way of heat shrinking for wrapping the iron core 11.

Figure 3C:
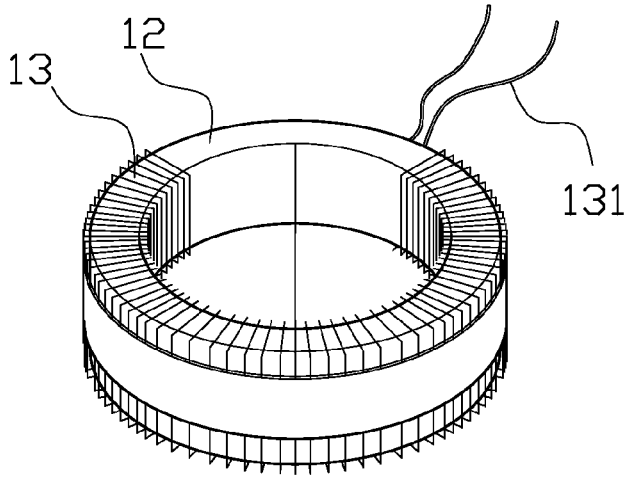
Figure 3D:
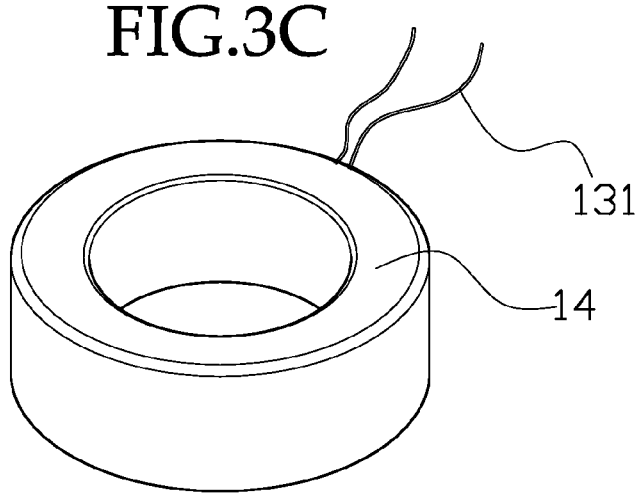

When the first time insulation processing is completed, a wire is wound in annular shapes to form a primary coil 13 such as is shown in FIG. 3C; when the primary coil 13 is completed, second time insulation processing is performed, another PVC heat shrinking wrapper is used to form a second insulation layer 14 in the way of heat shrinking for wrapping the primary coil 13 of the entire annular transformer 10 such as is shown in FIG. 3D.

Figure 3E:
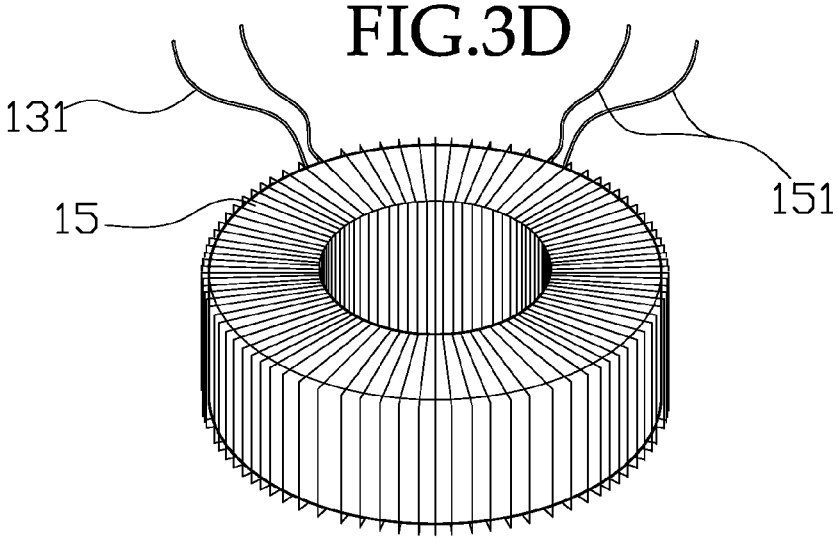

Then as is shown in FIG. 3E, second time wire winding is performed. In completion of the wire winding, a secondary coil 15 is formed; then third time insulation processing is performed, another PVC heat shrinking wrapper is used to form a third insulation layer 16 in the way of heat shrinking for wrapping with a pair of input wires 131 on the end of the primary coil 13 and a pair of output wires 151 on the end of the secondary coil 15 being left to expose, please also refer to the annular transformer 10 as shown in FIG. 2.

The annular transformer 10 of the present invention is mounted in a housing 20; the input wires 131 of the transformer are connected to a plug 221 outside of the housing 20 for obtaining electric power, while the output wires 151 are electrically connected to an electric power line 23 of an electronic product. The housing 20 can be designed to be a mouse for a computer.

The power supply transformer with high efficiency of the present invention has its iron core 11 in the form of a closed annular member, its magnetic circuit basically is a closed magnetic circuit, thereby its energy of magnetizing and consumption of the iron core are 25% less than those of a conventional stacking type iron core, this largely increases the efficiency of the power supply. Moreover, the iron core 11 is a closed annular member having no air gap, its stacking factor is high up to 95%, the magnetic conductivity of the iron core 11 can reach 1.5~1.8 T (tesla), a primary and a secondary copper wire coil 13 and 15 of low specifications made by winding are adopted, this results large reducing of weight and volume of the entire power supply transformer.

The power supply transformer with high efficiency of the present invention can be an A.C. to A.C. transformer with a frequency of 50 or 60 MHz; and can be an A.C. to D.C. transformer, it needs only to add a rectifying filtering circuit on the output end of the secondary coil to change the output voltage from A.C. to D.C.

The power supply transformer with high efficiency of the present invention can have its input voltage and its output voltage changed at will in pursuance of requirement; its power can also be changed by magnitude in pursuance of the size of the annular iron core 11 and the copper wires in designing.

FIG. 4 is a chart showing the specification of electric features of the present invention.

The followings are description about other features of the present invention:

The coils 13, 15 in the power supply transformer with high efficiency of the present invention are directly wound around the iron core 11 having been insulation processed, and needs no fixing with a bobbin (a coil of a normal power supply transformer must be wound around a bobbin before it is mounted on an iron core).

The power supply transformer with high efficiency of the present invention is heated after its iron core 11 is wrapped with the first insulation layer 12 formed from a PVC heat shrinking wrapper and is fixed with a tool, the PVC material is completely combined with the iron core 11 to render the surface of the iron core 11 insulated.

After the primary coil 13 of the power supply transformer with high efficiency of the present invention is formed by being uniformly wound by using an annular winding machine, it is wrapped and insulated with a PVC heat shrinking wrapper, the secondary coil 15 formed is wound around an insulating coat 14, in contrast, the conventional linear power source is insulated with mylar plastic tapes.

The magnetizing current of the power supply transformer with high efficiency of the present invention is zero when in no load of a linear power source with a rated input voltage; while the magnetizing current when in no load of a normal linear power source with rated input voltage is larger than zero. And more, the linear power source provided in the present invention can still work normally after being burned in full load with 125% input voltage for 24 hours; while the normal linear power source is unable to work normally after being burned in full load with 125% input voltage for 24 hours.

The efficiency of the power supply transformer with high efficiency of the present invention with a rated input voltage and a rated output power (as shown in FIG. 4) is larger than 70% (the efficiency of a conventional linear power source is lower than 60%).

The surface temperature of the power supply transformer with high efficiency of the present invention after being burned in full load with 125% input voltage for 24 hours rises no more than 40° C. (the temperature rises more than 75° C. for a normal linear power source).

The total weight of the power supply transformer with high efficiency of the present invention does not exceed 300 g (for 15 W as an example, a normal linear power source is larger than 500 g).

Figure 5:
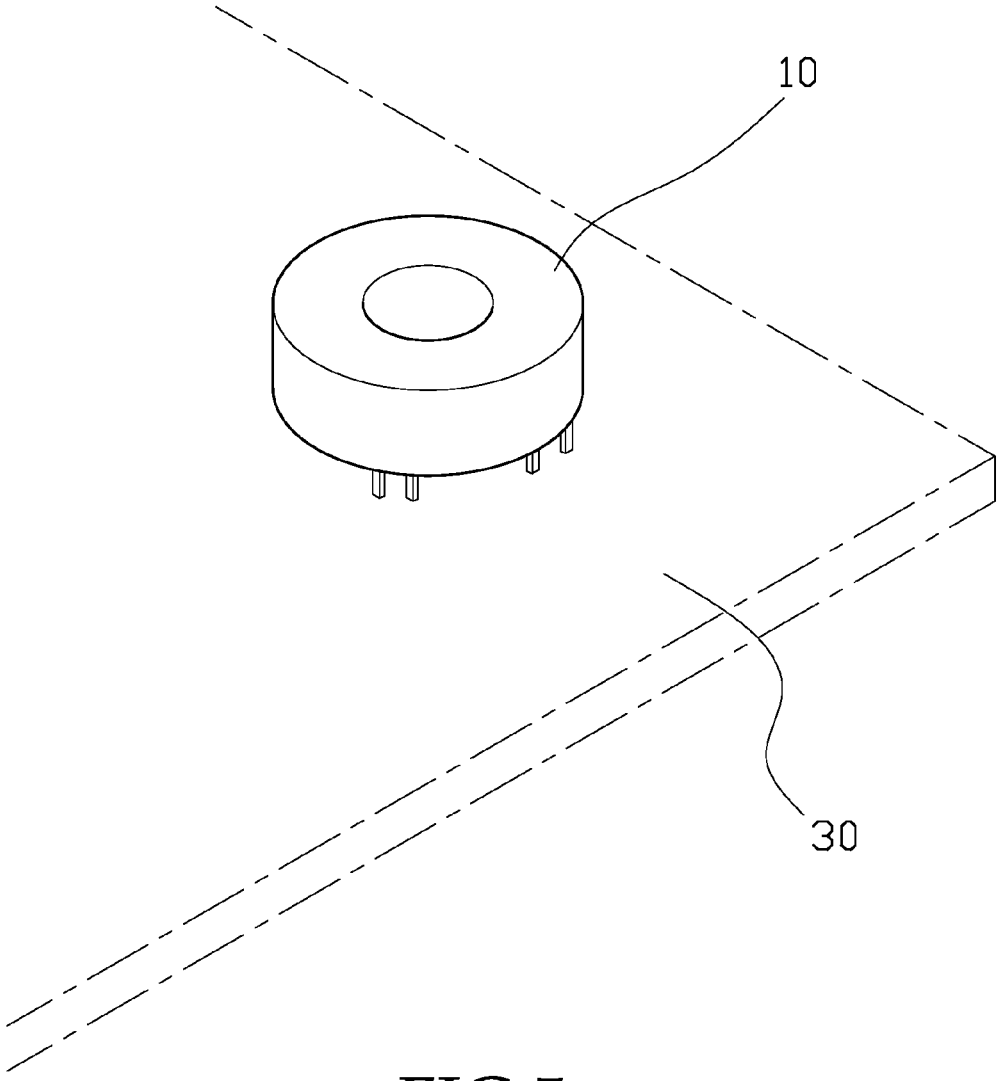
FIG. 5 is a perspective schematic view showing application of an annular transformer of the present invention directly inserting in an electric circuit board.

And as shown in FIG. 5, annular transformer 10 of the present invention can be used as a transformer for direct inserting into an electric circuit board 30, and can also be used as a rectifier for a fluorescent lamp. Thereby, the present invention is not limited to the application range of a power supply transformer.

My invention is to be construed as including all modifications and variations falling within the scope of the appended claims.

The invention claimed is:

1. A transformer with high efficiency, said transformer comprises:

an iron core being a closed annular member made by continuous winding from a silicon steel sheet, and then being completed by being sintered and fixed to keep its directionality; after first time insulation processing with a heat shrinking wrapper on said iron core, a first insulation layer being formed;

a primary coil being formed by winding a wire in annular shapes on said first insulation layer, then by being enveloped by a second insulation layer formed by second time insulation processing with a heat shrinking wrapper; and a secondary coil being formed by winding a wire in annular shapes on said second insulation layer, and then by being enveloped by a third insulation layer formed by third time insulation processing with a heat shrinking wrapper; said third insulation layer having a pair of end input wires of said primary coil as well as a pair of end output wires of said secondary coil extended outwards;

said input wires of said primary coil input electric power, and said output wires of said secondary coil output voltage-changed electric power, thereby an annular transformer being formed.

2. The transformer with high efficiency as claimed in claim 1, wherein in forming of said iron core, a silicon steel roll is parallely cut, said cut silicon steel sheet is continuously wound by using an automatic winding machine to form a closed annular member; said closed annular member is sintered in nitrogen gas, annealed in a tunnel, and is immersed in vacuum immersing paint and is baked to have its shape fixed, this keeps directionality.

3. The transformer with high efficiency as claimed in claim 1, wherein magnetic conductivity of said iron core reaches 1.5~1.8 T (tesla).

4. The transformer with high efficiency as claimed in claim 1, wherein said transformer is a power supply transformer, wherein said annular transformer is mounted in a housing; said input wires are connected to a plug outside of said housing for obtaining electric power, while said output wires are electronically connected to an electric power line of an electronic product.

5. The transformer with high efficiency as claimed in claim 4, wherein said housing is a mouse used on a computer.

6. The transformer with high efficiency as claimed in claim 1, wherein a rectifying filtering circuit is provided on an output end of said secondary coil to change output voltage from A.C. to D.C.

7. The transformer with high efficiency as claimed in claim 1, wherein output power of said transformer is changed by magnitude in pursuance of size of said annular iron core and said copper wires.

8. The transformer with high efficiency as claimed in claim 1, wherein said heat shrinking wrappers used to form said first, second and third insulation layers are PVC heat shrinking wrappers.

9. The transformer with high efficiency as claimed in claim 1, wherein said iron core of said transformer is made by winding short silicon steel sheets.

* * * * *